US006463994B1

(12) United States Patent
Nitz et al.

(10) Patent No.: US 6,463,994 B1
(45) Date of Patent: Oct. 15, 2002

(54) APPARATUS AND METHOD FOR GRAVITY CASTING A MOTORCYCLE WHEEL

(75) Inventors: John D. Nitz, Ypsilanti; Jiang Z. Shi, Ann Arbor, both of MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 09/473,379

(22) Filed: Dec. 28, 1999

Related U.S. Application Data

(60) Provisional application No. 60/113,983, filed on Dec. 28, 1998.

(51) Int. Cl.[7] ..... B22D 17/26; B22D 33/04

(52) U.S. Cl. ..... 164/342; 164/340; 164/137

(58) Field of Search ..... 164/348, 305, 164/DIG. 14; 29/894

(56) References Cited

U.S. PATENT DOCUMENTS

| | | | | |
|---|---|---|---|---|
| 4,035,895 A | | 7/1977 | Lester | |
| 4,047,764 A | | 9/1977 | Lester | |
| 4,118,073 A | | 10/1978 | Marwitz | |
| 4,256,348 A | | 3/1981 | Lester et al. | |
| 5,320,160 A | * | 6/1994 | Kato et al. | 164/133 |
| 5,647,426 A | * | 7/1997 | Prieto et al. | 164/122.1 |
| 6,186,218 B1 | * | 2/2001 | Prieto | 164/339 |

FOREIGN PATENT DOCUMENTS

| | | | |
|---|---|---|---|
| JP | 402041737 A | * | 2/1990 |
| JP | 404200842 A | * | 7/1992 |

* cited by examiner

*Primary Examiner*—M. Alexandra Elve
*Assistant Examiner*—Kevin McHenry
(74) *Attorney, Agent, or Firm*—MacMillan, Sobanski & Todd, LLC

(57) ABSTRACT

An improved mold for casting motorcycle wheels includes a wider rim cavity having smooth contours to facilitate the flow of molten metal within the mold cavity.

6 Claims, 6 Drawing Sheets

APPARATUS AND METHOD FOR GRAVITY CASTING A MOTORCYCLE WHEEL

CROSS REFERENCE TO RELATED APPLICATIONS

This application claims the benefit of U.S. Provisional Application No. 60/113,983, filed on Dec. 28, 1998.

BACKGROUND OF THE INVENTION

This invention relates in general to motorcycle wheels and in particular to an apparatus and method for casting motorcycle wheels.

One piece motorcycle wheels formed from alloys of light weight metals such as aluminum, magnesium and titanium are becoming increasingly popular. Such wheels can be formed by conventional gravity casting processes which utilize highly automated casting machines. A type of automated casting machine has a plurality of multiple piece wheel molds mounted upon a carrousel. The carrousel is rotationally indexed to move the molds into a charging position where a charge of molten metal is poured into the mold. As the carrousel continues to be indexed, the molten metal cools and solidifies into a wheel casting. The wheel mold is then opened and the casting removed. The mold is reclosed and returned to the charging position. Other types of automated casting machines also can be used. Sprues and risers are removed from the wheel casting and the casting machined to a final shape.

Referring now to FIG. 1, there is shown generally at 10, a typical prior art motorcycle wheel mold. The mold includes a base member 11 which is mounted upon a casting machine carrousel (not shown) and supports the other mold components. The mold 10 also includes a plurality of horizontally movable side members. As shown in FIG. 1, the mold 10 includes a left side member 12 and a right side member 13. The mold 10 further includes a vertically movable cup shaped top core 14. A ball member 15, which has an inverted cup shape, is attached to the upper surface of the center of the top core 14.

As shown in FIG. 1, the side members 12 and 13 and top core 14 are in their extended positions and cooperate to define a mold cavity 20. The mold cavity includes an annular rim cavity 21 connected by a plurality of radial spoke cavities 22 (one shown) to a central hub cavity 23. The ball member 15 defines a ball riser 24 which is adjacent to the upper end of the hub cavity 23. Similarly, an axially extending annular rim riser 25 is formed in the side members 12 and 13 adjacent to the upper end of the rim cavity 21. As shown in FIG. 1 a gate 30 is formed in the right side member 13. The gate 30 includes a conical inlet chamber 31 which receives the molten metal. The inlet chamber 31 communicates through a passageway 32 with an intermediate chamber 33. An axial slot 35 provides communication between the intermediate chamber 33 and the mold cavity 20.

To cast a motorcycle wheel, a charge of molten metal is poured into the gate 30. The molten metal flows into the rim cavity 21 and through the spoke cavities 22 into the hub cavity 23. Additional molten metal is accumulated in the ball riser 24 and the rim riser 25. As the metal in the wheel cavity 20 cools, the metal contracts and gravity causes additional molten metal to flow from the ball and rim risers 24 and 25 into the mold cavity 20. Once the metal has solidified, the top core 14 and ball member 15 are raised and the side members 12 and 13 retracted to allow removal of the wheel casting. The ball and rim risers are cut from the casting and the casting machined to a final shape, which is shown by the dashed outline labeled 37 in FIG. 1. In order to minimize machining, the shape of the rim cavity 21 closely approximates the shape of the finished motorcycle wheel rim.

SUMMARY OF THE INVENTION

This invention relates to an improved apparatus and method for casting motorcycle wheels.

Due to the geometry of motorcycle wheels, the wheel rim and spokes have small cross-sectional areas. Accordingly, the metal in the spoke and rim cavities tends to cool more rapidly than the metal in the hub cavity. Referring again to FIG. 1, as explained above, the rim cavity is shaped to closely follow the final rim shape of the wheel. This is done to minimize the amount of machining needed to finish the wheel. However, as the metal in the spoke cavities 22 solidifies, the flow of molten metal from the hub ball riser 24 to the rim cavity 21 is blocked. Similarly, as the metal in the rim cavity 21 solidifies, the flow of molten metal from the rim riser 25 can be blocked. Thus, shrinkage in the rim and spoke cavities 21 and 22 may not be replaced with additional molten metal and might lead to rejection of the wheel casting. Therefore, it would be desirable to provide an improved mold which would assure that additional molten metal can be supplied to the rim and spoke cavities 21 and 22.

The present invention contemplates a mold for casting a motorcycle wheel which includes a base member and a plurality of side members with at least one of the side members including a gate adapted to receive molten metal. The mold also includes a top core and the mold has a central axis. The top core cooperates with the base member and side members to define a mold cavity having an annular portion which defines a rim cavity for casting a motorcycle wheel rim. The mold cavity communicates with the gate formed in the side member. An annular rim riser is formed upon an end of the rim cavity. The rim cavity has a gently undulating outer surface between the annular rim riser and spoke cavities so that there are no more than two changes of direction relative to the mold central axis and the rim cavity has a sufficient width to facilitate the flow of molten metal from the rim riser into the mold cavity. The mold members further define a central hub cavity which communicates with the rim cavity through at least one radial spoke cavity. The central hub cavity communicates with a hub riser.

The invention also contemplates that a slot is formed in the side member, the slot communicating either between the gate and the rim riser cavity or between the gate and the rim cavity. Alternately, a first slot can be formed in the side member which communicates between the gate and the rim riser cavity and a second slot can be formed in the side member which communicates between the gate and the rim cavity.

The invention further contemplates a process for casting a motorcycle wheel which includes providing the motorcycle wheel mold described above. Molten metal is poured into the mold gate, the molten metal filling the rim cavity and flowing through at least one of the wheel spoke cavities fill the central hub cavity. The molten metal is allowed to cool sufficiently to solidify into a motorcycle wheel casting. The mold is then opened and the casting removed.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
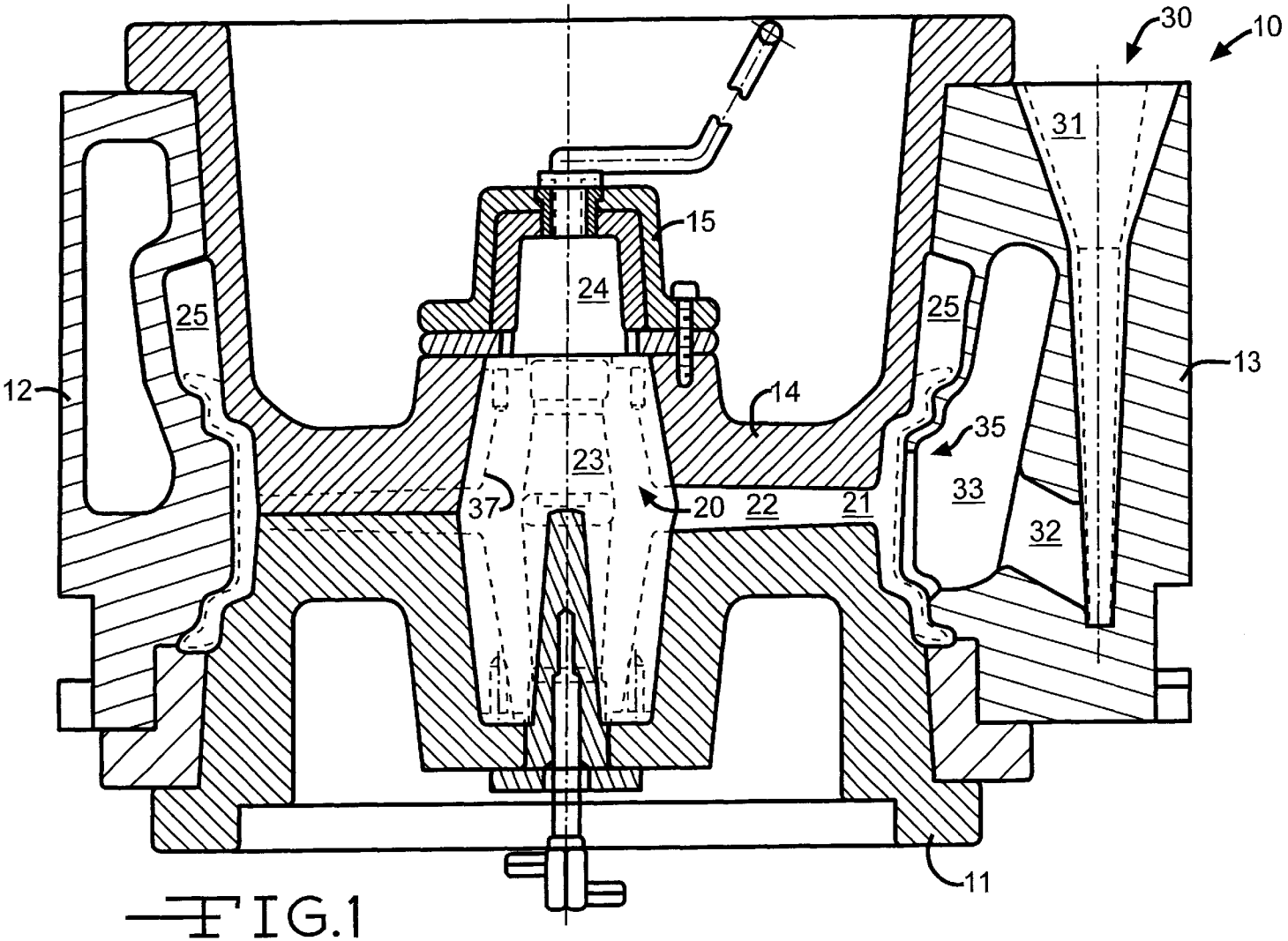
FIG.1 PRIOR ART
FIG. 1 is a sectional view of a prior art mold for casting a motorcycle wheel.
Figure 2:
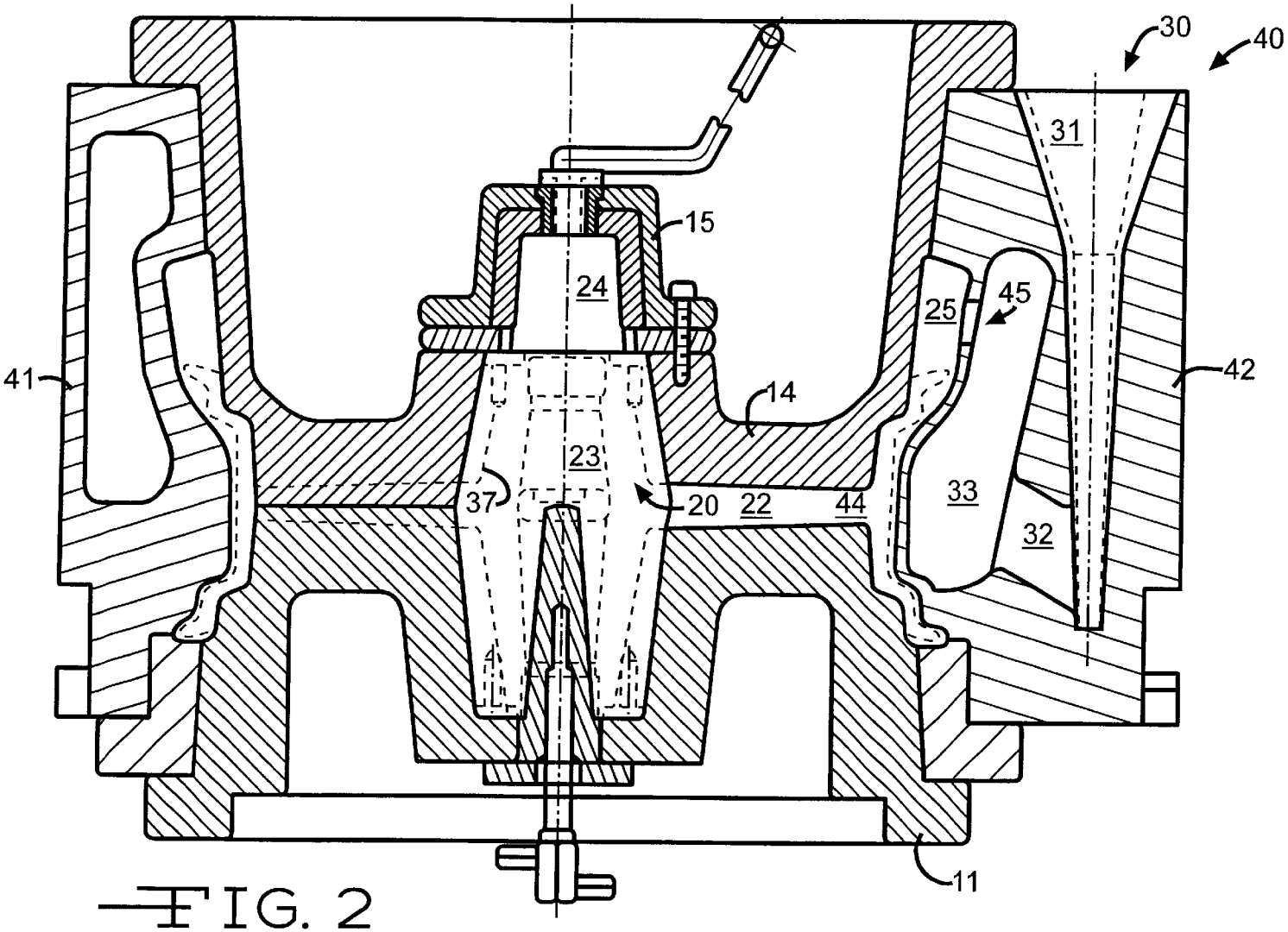
FIG. 2 is a sectional view of a mold for casting a motorcycle wheel in accordance with the present invention.

Referring again to the drawings, there is illustrated generally at 40 in FIG. 2 an improved mold for casting motorcycle wheels. Components of the mold 40 shown in FIG. 2 which are similar to components shown in FIG. 1 have the same numerical designators. The mold 40 includes a left side member 41 and a right side member 42 which are shaped to provide a wider rim cavity 44 in the radial direction to facilitate the flow of molten metal from the rim riser 25 into the rim cavity 44. The increased width of the rim cavity 44 increases the mass of metal in the upper portion of the rim cavity which slows the rate of solidification of the metal within the wheel rim cavity, allowing more time for molten metal to flow out of the rim riser 25. Additionally, the contour of the outer surface of the rim cavity 44 has been smoothed to provide both the greater rim cavity width and a smooth flow path for molten metal from the rim riser 25. The sharp directional changes apparent in the drawing of the outer surface of the rim cavity 21 of the prior art mold 10 shown in FIG. 1 have been eliminated. Similar to the mold 10 shown in FIG. 1, the right side member 42 includes a gate 30. However, the gate includes a slot 45 formed between the intermediate chamber 33 and the rim riser 25 for supplying molten metal to the mold cavity 20.

Figure 3:
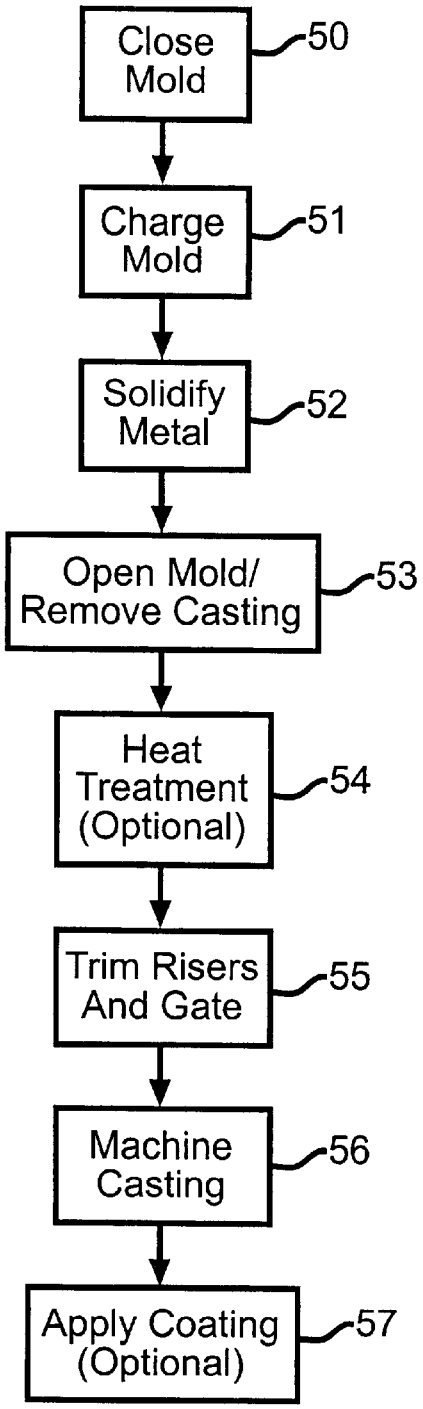
FIG. 3 is a flow chart for a method for casting a motorcycle wheel which uses the mold shown in FIG. 3.

The invention also contemplates an improved process for gravity casting a motorcycle wheel which is illustrated by the flow chart shown in FIG. 3. In functional block 50, a motorcycle wheel mold, which includes the improved rim cavity shape described above, is closed. A charge of molten metal is poured into the mold gate in functional block 51. Gravity causes the molten metal to flow into the rim riser 25 and the rim cavity 44. The molten metal continues to flow though the spoke cavities 22 to fill the hub cavity 23 and ball riser 24.

The molten metal cools and solidifies in functional block 52. Because of the additional width and smoothed contour of the rim cavity 44, molten metal contained in the rim riser 25 can easily flow in a downward direction in FIG. 2 into the rim cavity 44 and to the juncture of the wheel spoke cavities 22 with the rim cavity 44. The cooling of the molten metal in the improved mold 40 tends to be bi-directional, with solidification beginning in the spoke cavities 22 and proceeding both outward into the rim cavity 44 and inward into the hub cavity 23. The shrinkage of metal in the rim cavity 44 is replaced by additional molten metal urged by gravity from the rim riser 25. Additionally, the molten metal in the rim riser 25 also is available to replenish shrinkage occurring in the outer radial portions of the wheel spoke cavities 22. The shrinkage of metal in the hub cavity 23 and the inner radial portions of the spoke cavities 22 is replaced by additional molten metal urged by gravity from the ball riser 24.

Once the metal has sufficiently solidified, the mold 35 is opened in functional block 53 and the motorcycle wheel casting removed. The casting is heat treated by a conventional method in functional block 54; however, this step is optional. In functional block 55, the ball and rim risers and the gate riser are cut from the motorcycle wheel casting. The casting is then machined to a finished shape in functional block 56. Optional decorative and or protective coatings are applied to the wheel surface in functional block 57.

Figure 4:
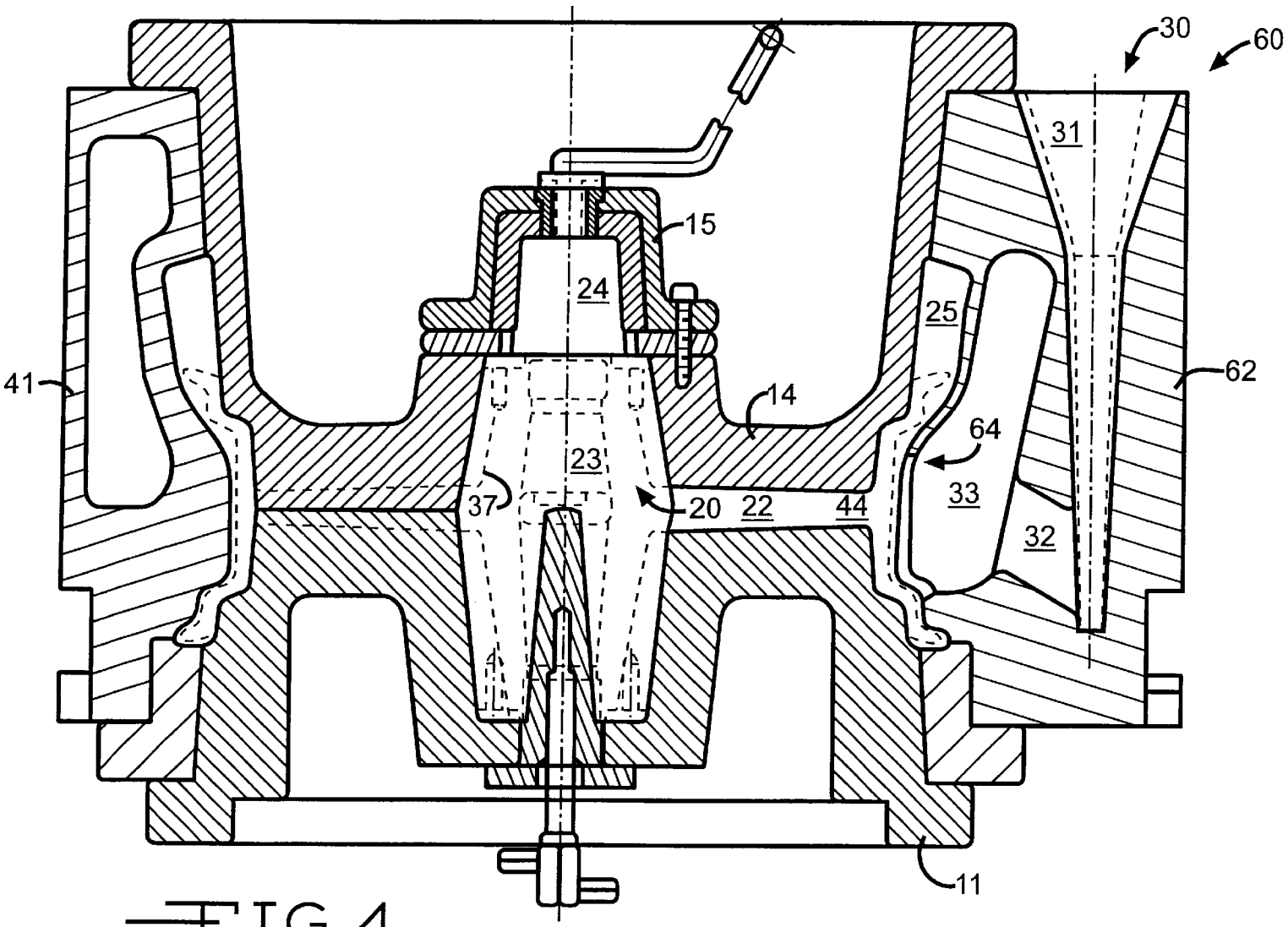
FIG. 4 is a sectional view of an alternate embodiment of the motorcycle wheel mold shown in FIG. 2.

An alternate embodiment of the improved motorcycle wheel mold is shown generally at 60 in FIG. 4. Components shown in FIG. 4 which are similar to components shown in FIG. 2 have the same numerical designators. The mold 60 includes a modified right side member 62. Similar to the wheel mold 10 shown in FIG. 1, an axial slot 64 provides communication between the intermediate chamber 33 and the rim cavity 44. The length of the slot allows molten metal to flow directly into the rim cavity 44. The molten metal also flows upward through the widened the rim cavity 44 into the rim riser 25 and radially thorough the spoke cavities 22 to fill the hub cavity 23 and ball riser cavity 24.

Figure 5:
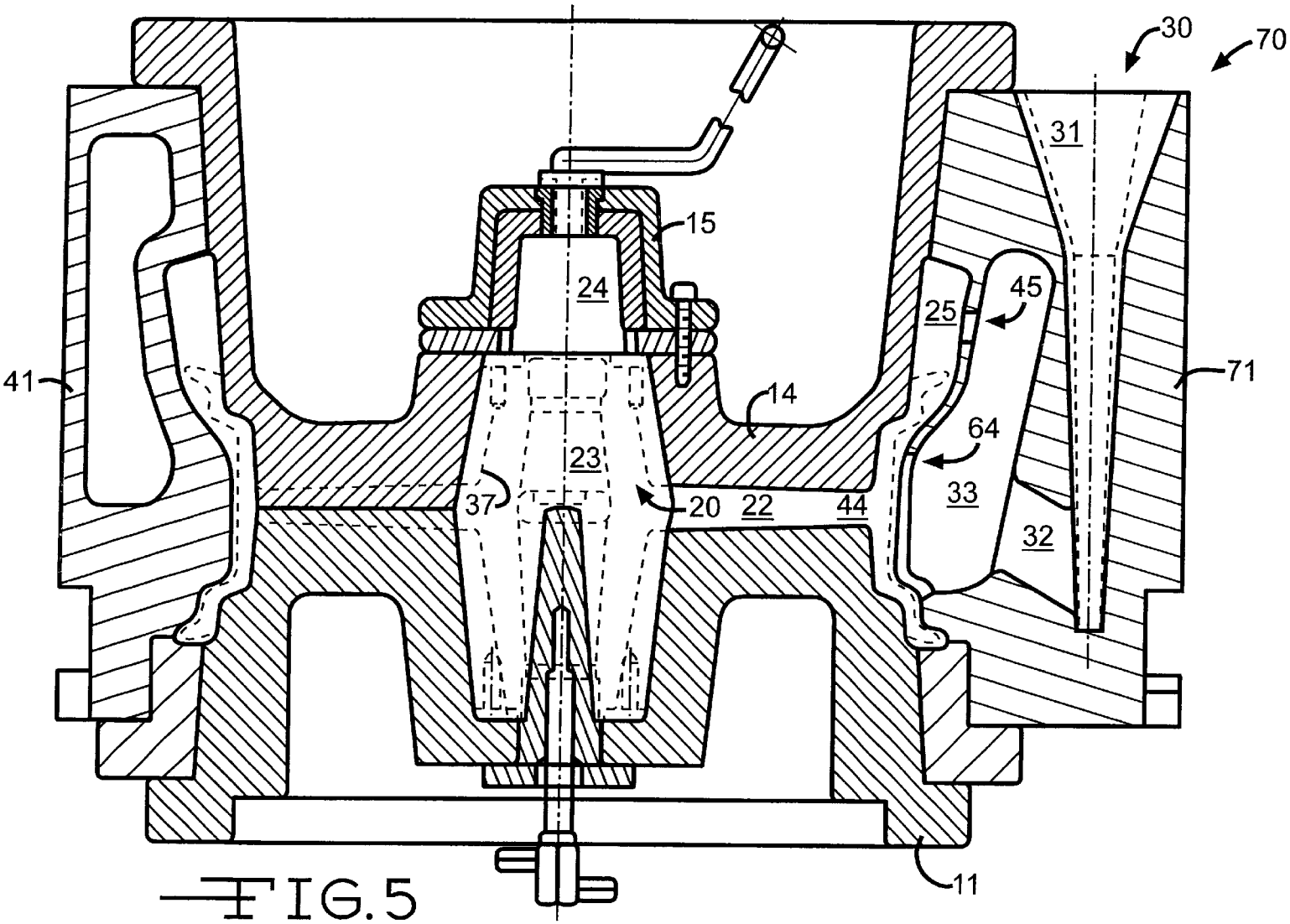
FIG. 5 is a sectional view of another alternate embodiment of the motorcycle wheel mold shown in FIG. 2.

Another alternate embodiment of the improved motorcycle wheel mold is shown generally at 70 in FIG. 5. As above, components shown in FIG. 5 which are similar to components shown in FIG. 2 have the same numerical designators. As shown in FIG. 4, the mold 70 includes a right side member 72 having both an upper slot 45 and a lower axial slot 64 which provide communication between the intermediate chamber 33 and both the rim riser cavity 25 and the rim cavity 44, respectively. Accordingly, molten metal flows simultaneously into the rim riser cavity 25 and the mold cavity 20.

As described above, the improved mold supplies additional molten metal to the spoke/rim intersection of the wheel casting from the rim riser rather than from the ball riser. Accordingly, the inventors believe that the gravity feed of the present invention is superior to low pressure casting processes which utilize the prior art mold illustrated in FIG. 1. It is expected that the improved mold will result in a lower rejection rate for the wheel castings which will lower production costs as scrap rates for castings are reduced. The improved mold also is expected to reduce tooling costs. The improvement is expected to produce sufficient cost savings that any additional machining costs due to the thicker cross section of the wheel rim are more than offset by the savings.

Figure 6:
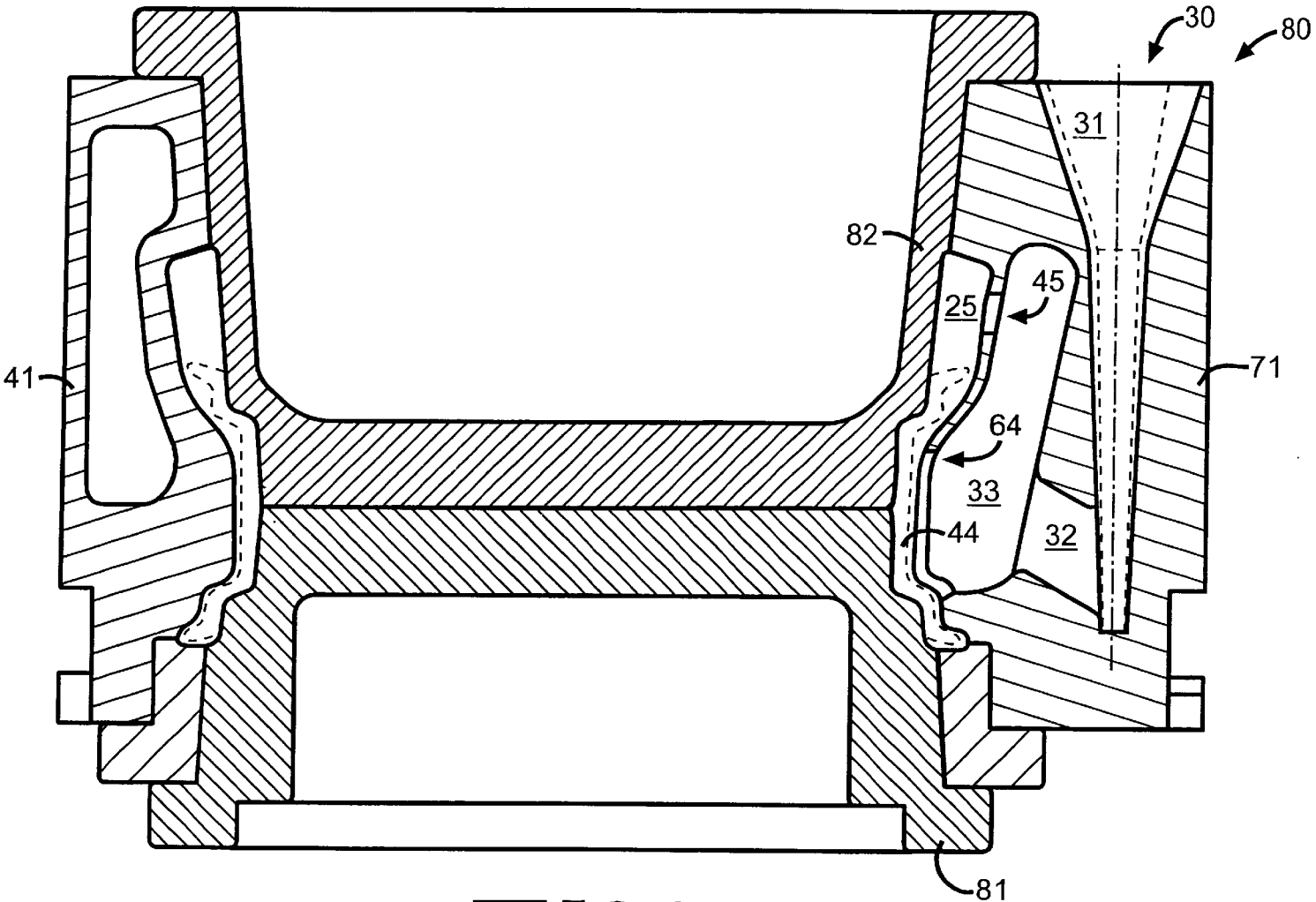
FIG. 6 is a sectional view of a mold for casting a motorcycle wheel rim in accordance with the present invention.

While the preferred embodiment of the invention has been illustrated and described for forming a one piece motorcycle wheel, it will be appreciated that the invention also can be used to cast a motorcycle wheel component. For example, the invention also can be applied to a mold 80, which is illustrated in FIG. 6, for casting a motorcycle wheel rim. The cast wheel rim is subsequently attached to a wheel disc or spider (not shown). Components in FIG. 6 which are similar to components in the preceding figures have the same numerical designators. The mold 80 includes a modified base member 81 and top core 82 which omit the spoke and hub cavities. While two slots 45 and 64 are illustrated for supplying molten metal to the rim riser 25 and rim cavity 44, it will appreciated that the mold 80 also can be formed with only one of the slots.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope. For example, the method for casting a motorcycle wheel illustrated in FIG. 3 and described utilizing the wheel mold shown in FIG. 2 also can be used with the molds shown in FIGS. 4 through 6.

What is claimed is:

1. A mold for casting a metal motorcycle wheel component, the mold having a central axis and comprising:

a base member;

a plurality of side members;

a gate formed in at least one of said side members, said gate adapted to receive molten metal; and a top core, said base member and side members cooperating with said top core to define a mold cavity having an annular portion defining a rim cavity for casting a motorcycle wheel rim, said rim cavity communicating with said gate, said top core and side members also cooperating to define an annular rim riser cavity formed on an end of said rim cavity, said top core also cooperating with said base member to define a central hub portion cavity connected by a plurality of radial spoke cavities to said rim cavity, said rim cavity having a gently undulating outer surface between said annular rim riser cavity and said spoke cavities, said gently undulating rim cavity outer surface having no more than two changes of direction relative to the mold central axis and a sufficient radial width whereby molten metal can first flow into said annular rim riser cavity and then subsequently can easily flow under the force of gravity from said riser cavity into said rim cavity.

2. A mold according to claim 1 wherein said mold members further define a central hub cavity, said hub cavity communicating with said annular portion of said mold cavity through at least one radial spoke cavity.

3. A mold according to claim 1 wherein the mold further includes a hub riser, said hub riser communicating with said central hub cavity.

4. A mold according to claim 3 wherein an axial slot is formed in said side member, said axial slot communicating between said gate and said rim cavity.

5. A mold for casting a metal motorcycle wheel component, the mold having a central axis and comprising:

a base member;

a plurality of side members, at least one of said side members including a gate adapted to receive molten metal;

a top core, said base member and side members cooperating with said top core to define a mold cavity having an annular portion defining a rim cavity for casting a motorcycle wheel rim, said top core and side members also cooperating to define an annular rim riser cavity formed on the end of said rim cavity, said rim cavity having a gently undulating outer surface and a sufficient radial width whereby molten metal can easily flow under the force of gravity from said riser cavity into said rim cavity, said top core also operating with said base member to define a central hub portion cavity connected by a plurality of radial spoke cavities to said rim cavity;

a first slot formed in said side member, said first slot communicating between said gate and said rim riser cavity; and a second slot formed in said side member, said second slot being displaced from said first slot in a direction parallel to the axis of the mold, said second slot communicating between said gate and said rim cavity.

6. A mold for casting a metal motorcycle wheel component comprising:

a base member;

a plurality of side members, at least one of said side members including a gate adapted to receive molten metal;

a top core, said base member and side members cooperating with said top core to define a mold cavity having an annular portion defining a rim cavity for casting a motorcycle wheel rim, said top core and side members also cooperating to define an annular rim riser cavity formed on an end of said rim cavity, said rim cavity having a gently undulating outer surface and a sufficient radial width whereby molten metal can easily flow under the force of gravity from said riser cavity into said rim cavity; and a gate formed in said side member that communicates directly with said rim riser cavity.

* * * * *